United States Patent [19]

Morita

[11] 4,047,882

[45] Sept. 13, 1977

[54] BURNING METHOD OF CERAMIC SHELL MOLD FOR PRECISION CASTING

[75] Inventor: Yasuji Morita, Kobe, Japan

[73] Assignee: Kubota, Ltd., Osaka, Japan

[21] Appl. No.: 669,454

[22] Filed: Mar. 22, 1976

[30] Foreign Application Priority Data

Mar. 26, 1975 Japan ..... 50-37127

[51] Int. Cl.[2] ..... F27D 3/16; F27B 15/00

[52] U.S. Cl. ..... 432/9; 164/12; 432/14

[58] Field of Search ..... 432/9, 14, 15, 197; 425/DIG. 20; 164/12

[56] References Cited

U.S. PATENT DOCUMENTS 2,771,648 11/1956 Valyi ..... 432/14

*Primary Examiner*—John J. Camby

*Attorney, Agent, or Firm*—Wenderoth, Lind & Ponack

[57] ABSTRACT

There is disclosed a method of burning a ceramic shell mold for use in precision casting for curing the ceramic shell mold. The ceramic shell mold is positioned within a heating compartment while a mass of sand within the heating compartment is fluidized so as to submerge the ceramic shell mold thereinto. Thereafter, particles of the sand are heated to a predetermined curing temperature, which sand particles then heat the ceramic shell mold enveloped by the sand particles.

3 Claims, 4 Drawing Figures

BURNING METHOD OF CERAMIC SHELL MOLD FOR PRECISION CASTING

The present invention relates to a method of burning a ceramic shell mold for use in precision or investment casting for curing the ceramic shell mold.

The ceramic shell mold to which the concept of the present invention is advantageously applicable is of a type having a mold cavity formed therein, which mold cavity has all the details of a target casting desired to be ultimately manufactured. Such a ceramic shell mold, however complicated the shape of the mold cavity is, can readily be manufactured by removing a disposal pattern which is a replica of the target casting, the removal of the disposal pattern resulting in formation of the mold cavity. The process generally starting from the manufacture of the ceramic shell mold to the manufacture of the target casting by the use of the ceramic shell mold is referred to as a 'lost-wax' precision casting or an investment casting.

As is well known to those skilled in the art, the ceramic shell mold as manufactured is so fragile that subsequent heat-treatment is required for curing the ceramic shell mold. In addition, it is a common practice to keep the cured ceramic shell mold at a substantially elevated temperature, prior to pouring molten metal into the mold cavity of the ceramic shell mold, so as to avoid the possibility of damage, such as cracking or destruction, which may otherwise result from rapid variation in temperature of the ceramic shell mold in contact with the elevated temperature of the molten metal being poured.

Heretofore, the ceramic shell mold has been treated in the subsequently described manner prior to the molten metal being poured into the mold cavity. Baking of the ceramic shell mold to cure the latter is carried out at a temperature within the range of 700° to 1,000° C. After the ceramic shell mold has been so cured, the shell mold is placed within a flask and a mass of sand is subsequently filled into the flask so as to support the ceramic shell mold in position within the flask with said ceramic shell mold substantially backed-up by or submerged into the sand. Then, the flask with the shell mold therein is transported into an electric or gas furnace where the shell mold in the flask is heated to a predetermined curing temperature of about 850° C. for a predetermined time within the range of 7 to 10 hours. While the shell mold attains the substantially constant temperature of about 850° C., molten metal is poured into the mold cavity to make a target casting having all the details of the mold cavity.

However, according to the above described, prior art method, since filling of the sand into the flask is a handwork, the time required to complete the filling of the sand into the flask is substantially prolonged and the sand being handled is likely to make the workshop environment offensive. Furthermore, where the ceramic shell mold is complicated in shape and, for example, is intended for use in the manufacture of a marine propulsive propeller, the sand cannot be filled, with no substantial difficulty, into portions below hollow projections of the ceramic shell mold which correspond to the propeller blades, or the ceramic shell mold will otherwise be damaged in view of the fact that even the cured ceramic shell mold is relatively fragile as compared with molds used in other casting processes.

Where the cured ceramic shell mold is to be heated within the electric furnace, the heating is carried out by radiant heat energies emitted from a heat source separate of the shell mold. Therefore, a relatively long period of time is required to heat the shell mold to the required predetermined temperature. Furthermore, depending upon the size and shape of the ceramic shell mold to be heated, a plurality of ceramic shell molds cannot be heated within the electric furnace of a given accommodation capacity simultaneously, with consequent reduction in productivity of the target castings. Moreover, since the radiant heat energies emitted from the heat source within the electric furnace are transmitted to the ceramic shell mold through the flask and if the flask is made of metallic material, the flask tends to be easily oxidized under the influence of the elevated temperature and/or greatly deformed in shape, and consequently the durability of the flask tends to be reduced.

Accordingly, the present invention has for its essential object to provide an improved method of heat-treating a ceramic shell mold, wherein the ceramic shell mold is substantially submerged in a mass of sand contained in a heating chamber of a heating furnace by fluidizing the sand mass within said heating chamber, thereby substantially eliminating the various disadvantages and inconveniences inherent in the prior art method.

Another important object of the present invention is to provide an improved method of heat-treating a ceramic shell mold, which can readily be practised accompanying substantial reduction of the heat-treating time, the amount of labor required and the amount of fuel used to produce heat energies for heating the ceramic shell mold, as compared with the prior art method referred to above.

According to the present invention, these objects can readily be accomplished by the employment of a heating furnace of a type comprising an open-topped kiln having at least two compartments, heating and combustion, divided by a perforated gas distributor, the heating compartment being situated immediately above the combustion compartment and accommodating a mass of sand therein and above the perforated gas distributor. While the combustion compartment is provided with one or more gas burners communicated to a source of fuel, such as oil or liquefied propane, and also to a source of air necessary to effect combustion of the fuel and also to produce a blast of hot gas under predetermined pressure towards the heating compartment through the perforated gas distributor, the combustion compartment is communicated to a source of compressed air necessary to fluidize the mass of sand within the heating compartment.

In the practice of the heat-treating method of the present invention, the ceramic shell mold carried by any suitable lifting instrument and therefore hanging from above is lowered into the heating compartment while the sand within the heating compartment is fluidized by the application of a compressed air under a predetermined pressure within the range of 1.0 to 2.5 kg/cm$^2$. During fluidization of the sand within the heating compartment, the ceramic shell mold can gradually be submerged into the fluidizing sand within a reasonable period of time, for example, 1/20 of the time required to position the ceramic shell mold in position within the flask according to the prior art method.

Positioning of the ceramic shell mold while the sand is fluidized provides an additional advantage that even the ceramic shell mold having a complicated shape and/or a relatively large size and/or a relatively small wall thickness can readily be enveloped by the sand uniformly.

Furthermore, according to the present invention, after the ceramic shell mold has been held in position within the heating compartment enveloped by the sand, a blast of hot gas is applied to the heating compartment under a predetermined pressure within the range of 0.5 to 1.0 kg/cm² from the gas burner or burners, which pressure is so selected that no fluidization of the sand within the heating compartment take place. Nevertheless, during the application of the hot gas, the supply of the compressed air from the compressed air source is interrupted.

The application of the hot gas from the combustion compartment towards the heating compartment through the perforated gas distributor such as a ceramic filter results in heating of particles of the sand which in turn heat the ceramic shell mold to a predetermined curing temperature, thereby curing the ceramic shell mold within the heating comparment. In other words, the ceramic shell mold is heated to the predetermined curing temperature by the effect of heat-exchange between the ceramic shell mold and the sand particles and, therefore, the heating efficiency is so high that, as compared with the heating by the effect of radiant heat energies according to the prior art method, the time required for curing the ceramic shell mold can advantageously be reduced to 1/20 to 1/30 of the time required in the prior art method with consequent reduction of the amount of fuel necessitated to cure the ceramic shell mold.

These and other objects and features of the present invention will readily be understood from the following description taken in connection with a preferred embodiment thereof with reference to the accompanying drawings, in which.

Figure 3:
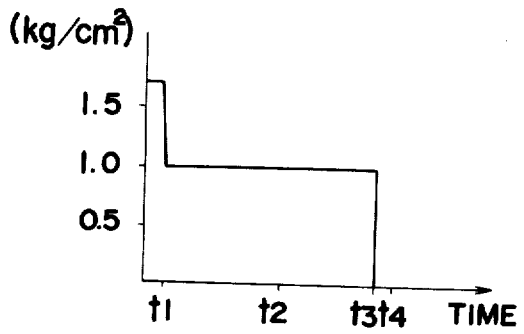
Figure 3:
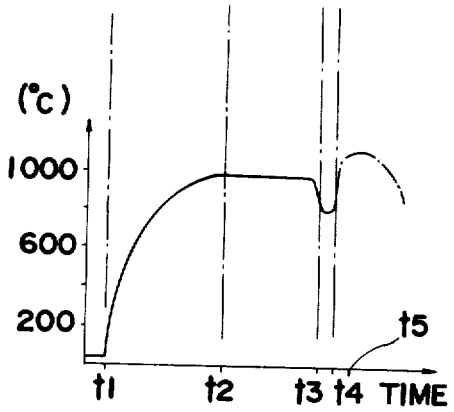

FIGS. 3(*a*) and (*b*) are graphs illustrative of pressure variation and temperature variation throughout the process of the invention, respectively, shown in timed relation to each other.

Figure 1:
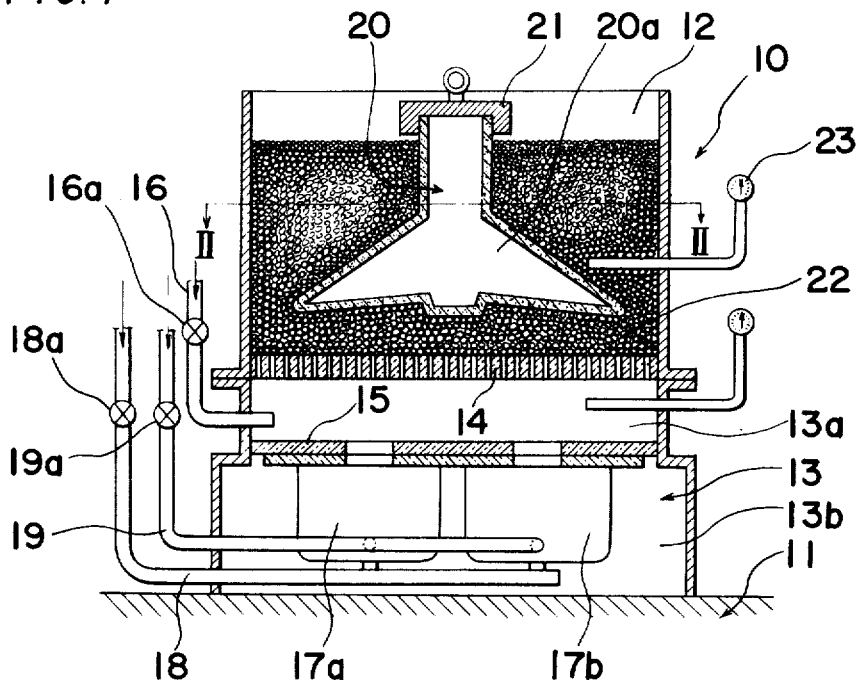
FIG. 1 is a longitudinal sectional view of an illustrative heating furnace which is employed in the practice of the method of the present invention.
Figure 2:
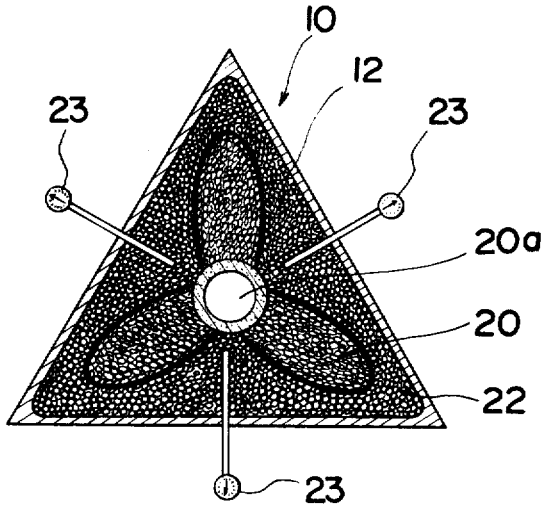
FIG. 2 is a cross sectional view taken along the line II—II in FIG. 1.

Referring to FIGS. 1 and 2, there is shown a heating furnace of a type comprising an open-topped kiln 10 steadily installed on any suitable foundation 11, such as a ground floor, and divided into heating and combustion compartments 12 and 13 by means of a perforated gas distributor 14, said heating compartment 12 being above the combustion compartment 13. The combustion compartment 13 is substantially divided into a gas chamber **13*a* and a burner chamber 13*b* by a support plate 15 positioned substantially intermediately of the height of the combustion compartment 13. While the gas chamber 13*a* is communicated to a source of compressed air (not shown) by means of a conduit 16 having an adjustment valve 16*a* thereon, the burner chamber 13*b* accommodates therein one or more, for example, two burners 17*a* and 17*b* supported by and hanging from the support plate 15. These burners 17*a* and 17*b* are communicated to a source of fuel (not shown) through a conduit 18 having an adjustment valve 18*a* thereon and also to a source of air through a conduit 19 having an adjustment valve 19*a*** thereon.

Accommodated within the heating compartment 12 is a mass of sand which, when a ceramic shell mold 20 is to be substantially submerged thereinto as will be described later, forms a fluidized bed by the application of compressed air of 1.0 to 2.5 kg/cm² from the compression air source.

In the practice of the method of the present invention, the ceramic shell mold 20 formed by removing a consumable pattern, which is a replica of a target casting desired to be ultimately maufactured, to define a mold cavity **20*a* having all the details of the pattern, is supported by any suitable lifting instrument, such as a crane, from above the top opening leading into the heating compartment 12. More specifically, the ceramic shell mold 20 is supported in such a manner that an opening of the ceramic shell mold 20, which leads into the mold cavity 20*a* and through which the consumable pattern has been removed, is upwardly oriented and closed by a lid 21 having an eyelet 21*a* for connection with a lifting cable (not shown), which lid 21 also serves as a holder for holding the ceramic shell mold 20**.

After or shortly before the ceramic shell mold so supported is mounted on the uppermost level of the sand within the heating compartment 12, compressed air is supplied through the duct 16 into the gas chamber **13*a* under a predetermined pressure within the range of 1.0 to 2.5 kg/cm², which compressed air in the gas chamber 13*a* flows upwards towards the heating compartment 12 through the perforated gas distributor 14, thereby causing the mass of sand to fluidize within said heating compartment 12**.

As the sand particles within the heating compartment 12 are fluidized, the ceramic shell mold 20 resting on the uppermost level of the sand 22 is drawn deep into the sand. The fluidization of the sand within the heating compartment 12 is continued until a major portion of the ceramic shell mold 20 except for that portion thereof which is held by the lid 21 is substantially submerged in the sand 22 while that portion of the ceramic shell mold which is held by the lid 21 is exposed outwardly from the uppermost level of the sand 22, as shown in FIG. 1.

It is to be noted that, since the sand is fluidized, positioning of the ceramic shell mold within the heating compartment 12 can readily be achieved, for example, within a period of time within the range of 5 to 15 seconds. In addition, however complicated the shape of the ceramic shell mold 20 is due to the shape of the target casting, for example, a marine propulsive propeller such as shown, the sand particles can penetrate into any shade of the ceramic shell mold where, according to the prior art method wherein the sand particles are rammed after the ceramic shell mold has been placed in position within the heating compartment, tends to be left unfilled with sand particles.

At the time the condition as shown in FIG. 1 is established, the ceramic shell mold 20 is substantially enveloped by and concurrently backed up by the mass of sand 22 within the heating compartment 12. The supply of the compressed air which has been necessitated to fluidize the sand 22 is then interrupted.

Thereafter, the ceramic shell mold 20 within the heating compartment 12 enveloped by the sand mass 22 is heated to a predetermined curing temperature. This can readily be achieved by igniting the burners **17*a* and 17*b* to cause the burners 17*a* and 17*b* to produce a blast of hot gas of a temperature within the range of 900° to 1,200° C, which blast of hot gas elevates towards the heating compartment 12 through the gas distributor 14 by way of the gas chamber 13a under such a predetermined gas pressure within the range of 0.5 to 1.0 kg/cm² that no substantial fluidization of the sand particles 20 take place within the heating compartment 12**.

As the hot gas of elevated temperature flows into the compartment 12 through the gas distributor 14, the sand particles 12 are first heated with the hot gas further flowing upwardly through interstices among the sand particles 22, which in turn undergo heat-exchange with the ceramic shell mold 20 to cure the latter. The heating of the ceramic shell mold 20 to the predetermined curing temperature can readily be achieved within a relatively short period of time. By way of example, a series of experiments conducted have shown that the ceramic shell mold for casting of a three-bladed propeller of 1,000 mm. in diameter could be heated to the curing temperature within the range of 700° to 1,000° C. within about 15 minutes. Furthermore, if the ceramic shell mold is heated to a temperature of about 1,000° C., removal of residues of the consumable pattern within the mold cavity, which is, according to the prior art method, practised prior to mounting of the ceramic shell mold in a heating furnace or flask, may be omitted.

After the sand particles have attained the maximum temperature in the manner as hereinbefore described, it is advisable to continue combustion of fuel by the burners 17a and 17b for 5 to 10 minutes so that a temperature difference can be minimized at any location. The possibility can be contemplated that, during this time, the temperature of the sand particles 22 can be automatically controlled by controlling the combustion of fuel by the burners 17a and 17b in response to the reading of thermometers 23 so arranged as to detect the temperature of the sand particles 22 as shown. For this purpose, the thermometers 23 may be electro-mechanically coupled to the adjustment valves 18a and 19a for regulating the supply of an air-fuel mixture to the burners 17a and 17b.

After the ceramic shell mold 20 has been cured for a predetermined period of time in the manner as hereinbefore described, the cured ceramic shell mold 20 is removed out of the heating compartment 12 and then transported to a casting location where molten metal is poured into the mold cavity 20a while the temperature of the ceramic shell mold 20 at the time of metal pouring operation is kept within the range of 700° to 850° C. Alternatively, the ceramic shell mold 20 having been cured and removed out of the heating compartment 12 may be transported to an electric or gas furnace prior to the metal pouring operation in a similar manner as hereinbefore described in connection with the prior art method.

With reference to FIGS. 3(*a*) and (*b*), there is shown a variation of the pressure received by the ceramic shell mold 20 within the heating compartment 12 and enveloped by the sand 22, which pressure variation is in turn shown in timed relation to a variation of the temperature as measured by the thermometers 23. In these graphs of FIGS. 3(*a*) and (*b*), a period from the zero point to the time $t_1$ represents the time required for the ceramic shell mold 20 to be substantially submerged into the mass of sand 22; a period of time from the time $t_1$ to the time $t_2$ represents the time required for the sand 22, heated by the burners 17a and 17b, to attain the predetermined curing temperature; and a period of time from the time $t_2$ to the time $t_3$ represents the time for the ceramic shell mold 20 to be cured. At the time $t_3$ and, more specifically, after the ceramic shell mold 20 has been heated for the predetermined time at the predetermined curing temperature, the ceramic shell mold 20 is removed out of the heating compartment 12 and subsequently transported to the casting location as hereinbefore described. During this process of removal and transportation, the temperature of the cured ceramic shell mold 20 may decrease and at a time $t_4$, that is, when the temperature of the cured ceramic shell mold 20 attains the predetermined temperature within the range of 700° to 850° C., pouring of molten metal into the mold cavity 20a is initiated which metal pouring completes at a time $t_5$. Thereafter, as indicated by a portion of the curve of FIG. 3(*b*) which is shown by the chain line, the poured molten metal begins to solidify to untimately form the target casting within the mold cavity 20a. The complete target casting can be obtained when the metal within the cavity 20a is completely solidified and removed from the ceramic shell mold 20 which may, depending upon the shape of the mold cavity, be broken.

From the foregoing description, it has now become clear that, since the ceramic shell mold is cured in contact with the sand particles which are heated to the predetermined temperature necessary to cure the ceramic shell mold, the ceramic shell mold can uniformly be cured within a reasonably reduced period of time, with consequent reduction of the amount of fuel as compared with the prior art method of a similar kind. Moreover, since prior to the curing of the ceramic shell mold, the latter is positioned within the heating compartment by fluidizing the mass of sand, formation of any void which may otherwise be formed with no sand filled in according to the prior art method can advantageously be avoided. In addition, positioning of the ceramic shell mold can readily be achieved in a relatively short period of time as compared with the prior art method.

The present invention having fully been described, it is to be noted that various changes and modifications are apparent to those skilled in the art. For example, depending upon the type and/or size of a mold to be heat-treated, a ceramic mold composed of mold halves can also equally be treated by the method of the present invention. Therefore, these changes and modifications are to be understood as included within the true scope of the present invention unless they depart therefrom.

What is claimed is:

1. A method of burning a ceramic shell mold for use in precision casting, which ceramic shell mold has a shaped cavity, defined therein, and at least one opening leading into said shaped mold cavity, said burning method being carried out by the use of a heating kiln of a type comprising heating and combustion compartments divided by a ceramic filter, said heating compartment being positioned immediately above said combustion compartment and accommodating therein a mass of sand, and a source of heating medium of elevated temperature, said burning method comprising the steps of:

positioning said ceramic shell mold from top into the mass of sand within the heating compartment while said mass of sand is fluidized by the application of compressed air flowing upwardly through the ceramic filter at a pressure within the range of 1.0 to 2.5 kg/cm², said ceramic shell mold being positioned such that the opening leading into the mold cavity projects outwardly from the top level of said mass of sand within said heating compartment;

interrupting the supply of the compressed air; and supplying the heating medium composed of a blast of hot gas from the combustion compartment into the heating compartment through said ceramic filter to heat said mass of sand and, in turn, said ceramic shell mold at a predetermined curing temperature for a predetermined time, said gas pressure being such as to avoid fluidization of the sand particles during this curing time.

2. A method as claimed in claim 1, wherein the burning of said ceramic shell mold is carried out by the effect of heat-exchange in contact with particles of said gaseous sand which are heated by said heating medium upwardly flowing through interstices among said sand particles.

3. A method accordng to claim 1, wherein the pressure of the blast of hot gas during the curing time is introduced under a pressure of 0.5 to 1.0 kg/cm$^2$.

* * * * *